US008677631B2

(12) United States Patent
Hanakawa

(10) Patent No.: US 8,677,631 B2
(45) Date of Patent: Mar. 25, 2014

(54) SCISSORS

(75) Inventor: Youichi Hanakawa, Osaka (JP)

(73) Assignee: Kokuyo Co., Ltd., Osaka-Shi, Osaka (JP)

( * ) Notice: Subject to any disclaimer, the term of this patent is extended or adjusted under 35 U.S.C. 154(b) by 561 days.

(21) Appl. No.: 12/662,131

(22) Filed: Mar. 31, 2010

(65) Prior Publication Data

US 2010/0263216 A1 Oct. 21, 2010

(30) Foreign Application Priority Data

Apr. 17, 2009 (JP) ..... P2009-100654
Mar. 18, 2010 (JP) ..... P2010-062395

(51) Int. Cl.
*B26B 13/00* (2006.01)

(52) U.S. Cl.
USPC ..... 30/244; 30/252; 30/254; 30/258

(58) Field of Classification Search
USPC ..... 30/254, 257, 239, 237, 255, 258, 330, 30/250, 252
See application file for complete search history.

(56) References Cited

U.S. PATENT DOCUMENTS 643,539 A * 2/1900 Rowe ..... 30/256
3,316,638 A * 5/1967 Mihalyi ..... 30/262
3,987,542 A * 10/1976 Visco ..... 30/233
4,150,484 A * 4/1979 Hildebrandt ..... 30/254
5,303,475 A * 4/1994 Baker ..... 30/254
7,966,735 B1 * 6/2011 Hayes ..... 30/254
2011/0203117 A1 * 8/2011 Huang ..... 30/254

FOREIGN PATENT DOCUMENTS

DE 801895 C 1/1951
DE 2303739 A1 1/1974
DE 4140425 C1 8/1992
GB 774767 A 5/1957
GB 2049528 A * 12/1980 ..... B26B 13/06

OTHER PUBLICATIONS

Kokuyo General Catalog: Kokuyo Co., Ltd., "HASA-1B" Stationery Edition of Kokuyo General Catalog for 2009, Dec. 2008: p. 539.
Extended European Search Report dated Jul. 27, 2010, in European Patent Application No. 10158684.0-2313.

* cited by examiner

*Primary Examiner* — Omar Flores Sanchez
(74) *Attorney, Agent, or Firm* — McGinn IP Law Group, PLLC

(57) ABSTRACT

A pair of scissors includes a pair of plate-shaped blades respectively formed by press working. Each of the blades pairing up with each other includes an edge line portion for sliding against the other blade and a recessed portion which is formed at a portion adjacent to the edge line portion with a difference in level from the edge line portion, which is away from a blade back face of the other blade in a thickness direction, and which has a bottom face substantially parallel to a blade back face of the edge line portion.

7 Claims, 6 Drawing Sheets

SCISSORS

BACKGROUND OF THE INVENTION

1. Field of the Invention

The present invention relates to a pair of scissors used at an office, at home or the like.

2. Description of the Related Art

Conventionally, a pair of scissors including a pair of blades respectively having flat blade back faces has been widely used at an office, at home or the like. However, if such a pair of scissors is used to cut tapes and sheets represented by adhesive tapes and kraft tapes on one surface of which an adhesive is applied, the adhesive adheres to the respective blade back faces of the pair of blades and the stuck adhesive causes a resistance to sliding of the respective blade back faces of the pair of blades to impair operability. Therefore, various structures of scissors for suppressing occurrence of such a problem have been figured out conventionally. As an example of such scissors, there is a known pair of scissors (e.g., refer to Kokuyo General Catalog: Kokuyo Co., Ltd. "HASA-1B" Stationery Edition of Kokuyo General Catalog for 2009, December, 2008: Page 539) in which blades are formed to have curved cross-sectional shapes protruding outward so that recessed portions are formed on blade back face sides. With this structure, an adhesive collects in the recessed portions on the blade back face sides and therefore it is possible to prevent occurrence of adhesion of the adhesive to the blade back faces.

To manufacture the pair of scissors described in the Kokuyo General Catalog, metal sheets are pressed to form a pair of blades having curved cross sections and the blades pairing up with each other are joined together for turning about a pivot. However, if the blades are formed by press working to manufacture the pair of scissors described in the Kokuyo General Catalog, shapes of the blades may become unstable because they warp again due to resilience after the metal sheets are formed into the blades, which means high working accuracy is required. If blade angles are reduced to increase sharpness, thickness of the blades cannot be secured in the blades having the curved cross-sectional shapes and therefore it is difficult to form sharp cutting edges.

SUMMARY OF THE INVENTION

It is an object of the present invention to solve the above-described problem. Specifically, objects of the present invention are to stabilize shapes of blades without requiring high working accuracy while suppressing occurrence of adhesion of the adhesive to blade back faces and to increase sharpness while maintaining durability.

With the above objects in view, the present invention takes the following measures.

A pair of scissors according to the present invention includes a pair of plate-shaped blades respectively formed by press working. Each of the blades pairing up with each other includes an edge line portion for sliding against the other blade and a recessed portion which is formed at a portion adjacent to the edge line portion with a difference in level from the edge line portion, which is away from a blade back face of the other blade in a thickness direction, and which has a bottom face substantially parallel to a blade back face of the edge line portion.

With this structure, the following effects can be obtained in addition to an effect of collecting adhesive in the recessed portions to thereby suppress occurrence of adhesion of the adhesive to the blade back faces. Specifically, because the blade back faces of the edge line portions and the bottom faces of the recessed portions are substantially parallel, both the blade back faces and the bottom faces of the recessed portions can be formed substantially flat. Therefore, though the blades are formed by press working, if the blades are formed into such shapes, it is not really necessary to consider change in shapes of the blades due to warping again due to resilience after metal sheets are formed into the blades. Therefore, it is possible to easily form the blades without requiring high working accuracy by employing any metal sheets. Moreover, with this structure, the whole blades are in substantially flat plate shapes and therefore thickness of the edge line portions can be secured and blade angles can be reduced in order to increase sharpness as compared with the blades with curved sections. As used in the present invention, "the bottom faces substantially parallel to the blade back faces of the edge line portions" include bottom faces perfectly parallel to the blade back faces of the edge line portions.

As a preferable shape for suppressing adhesion of the adhesive to the edge line portions while securing strength of the blades of the pair of scissors, width of the edge line portions may be set to 0.8 mm to 1.2 mm.

According to an especially preferable aspect for securing the strength of the blades of the pair of scissors, each of the blades may include the edge line portion and a blade back portion formed at an opposite side end edge from the edge line portion and having a back face positioned in the same plane as the blade back face of the edge line portion and the recessed portion has step forming faces respectively formed between the bottom face and the blade back face of the edge line portion and between the bottom face and the back face of the blade back portion.

In the pair of scissors described in the previous paragraph, if each of the blades further includes a blade tip portion positioned at a tip end portion and having a back face positioned in the same plane as the blade back face of the edge line portion and a blade base portion positioned at a base end portion and having a back face positioned in the same plane as the blade back face of the edge line portion and step forming faces are formed between the bottom face and the back face of the blade tip portion and between the bottom face and the back face of the blade base portion as well, it can positively influence the strength of the blades of the pair of scissors.

With this structure of the pair of scissors according to the present invention, it is possible to obtain the following effects, even though the blades are formed by press working. Specifically, because the blade back faces of the edge line portions and the bottom faces of the recessed portions are substantially parallel, both the blade back faces and the bottom faces of the recessed portions are substantially flat. Therefore, it is possible to more easily form the blades in which the adhesive is less likely to adhere to the blade back faces of the edge line portions without requiring high working accuracy by employing any metal sheets. Moreover, with this structure, the whole blades are in substantially flat plate shapes and therefore thickness of the edge line portions can be secured and blade angles can be reduced in order to increase sharpness as compared with the blades with curved sections.

DETAILED DESCRIPTION OF THE PREFERRED EMBODIMENTS

An embodiment of the present invention will be described below.

Figure 1:
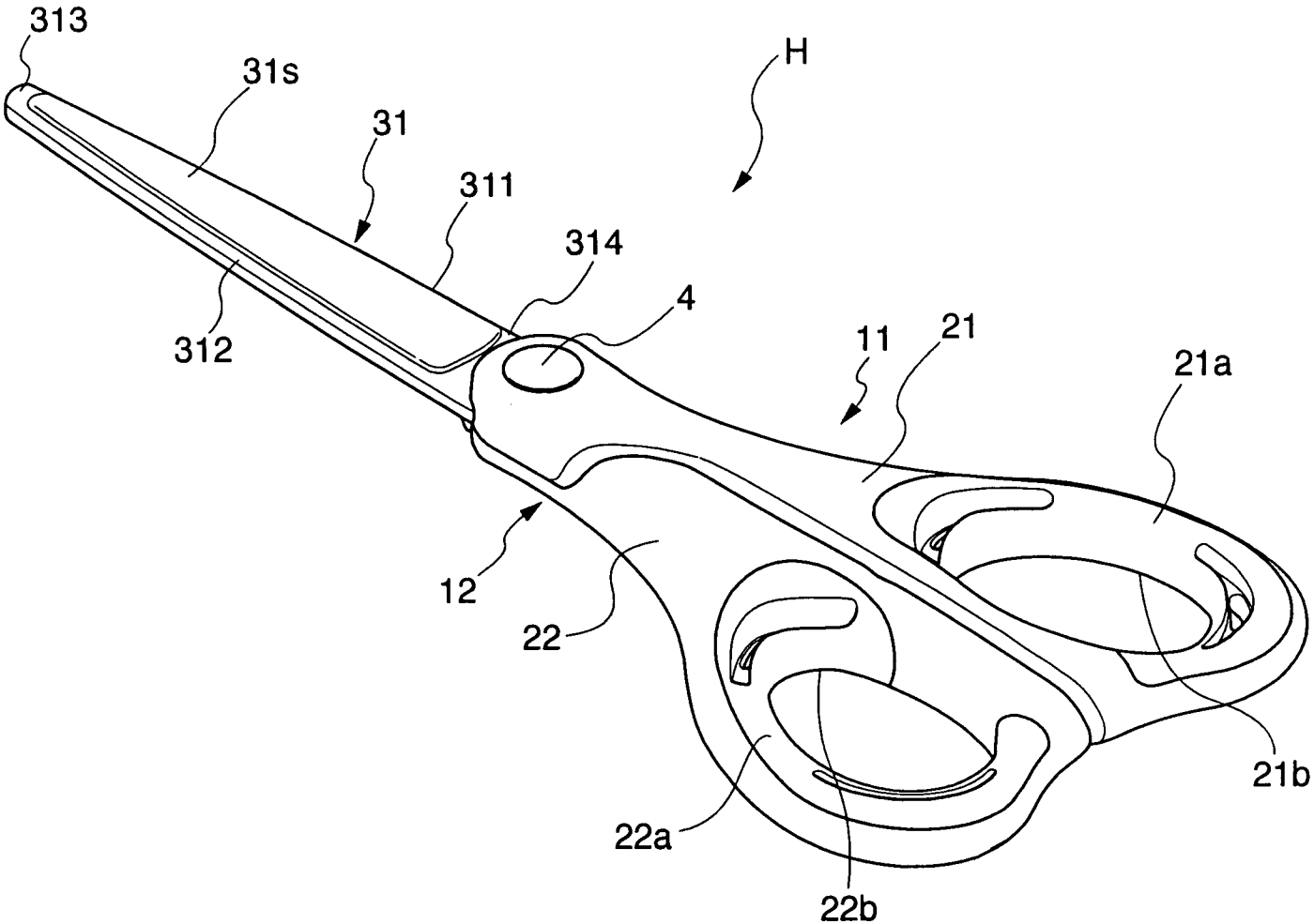
FIG. 1 is a perspective view of a pair of scissors according to an embodiment of the present invention.
Figure 2:
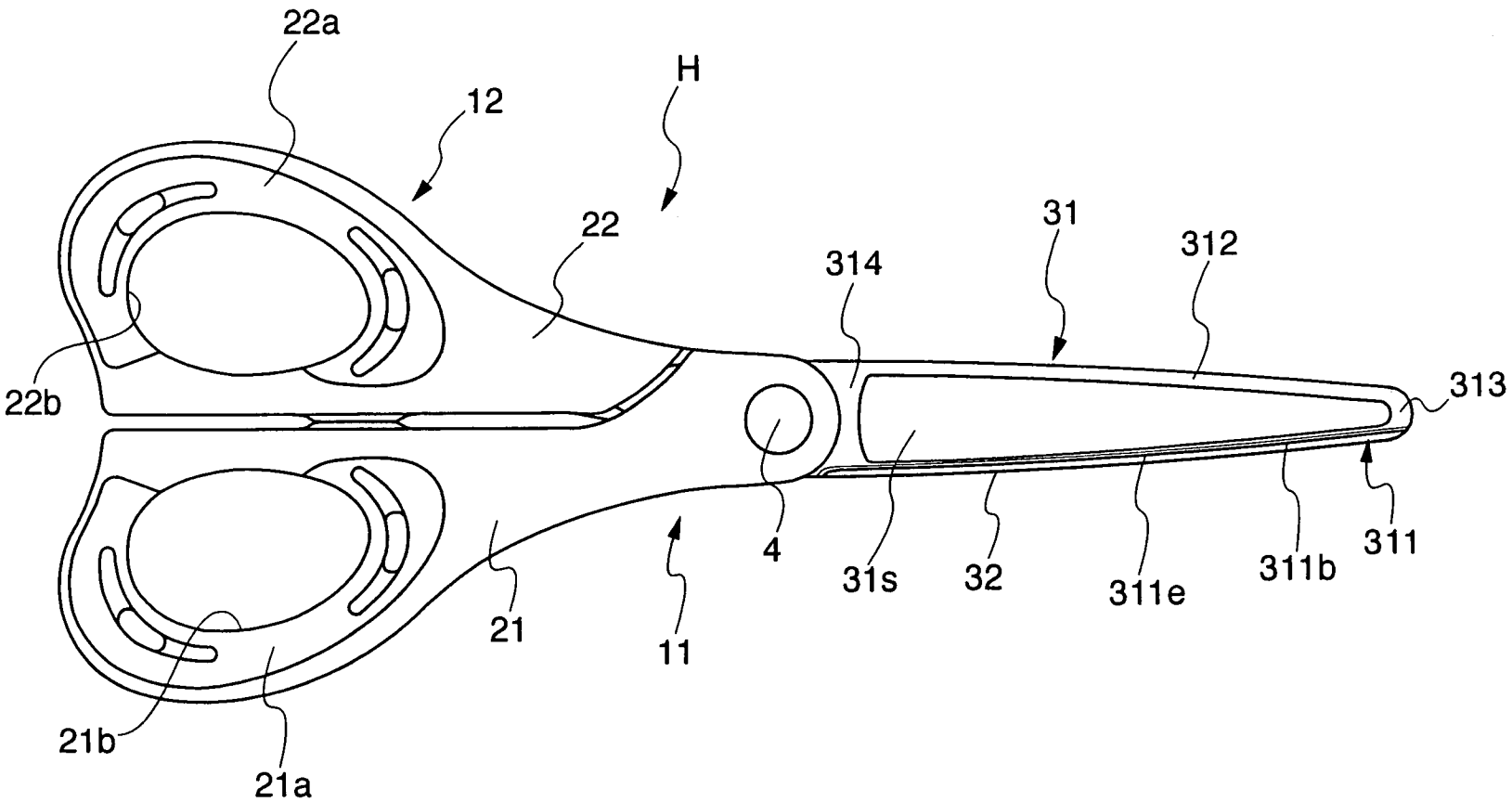
FIG. 2 is a plan view of the pair of scissors according to the embodiment.
Figure 3:
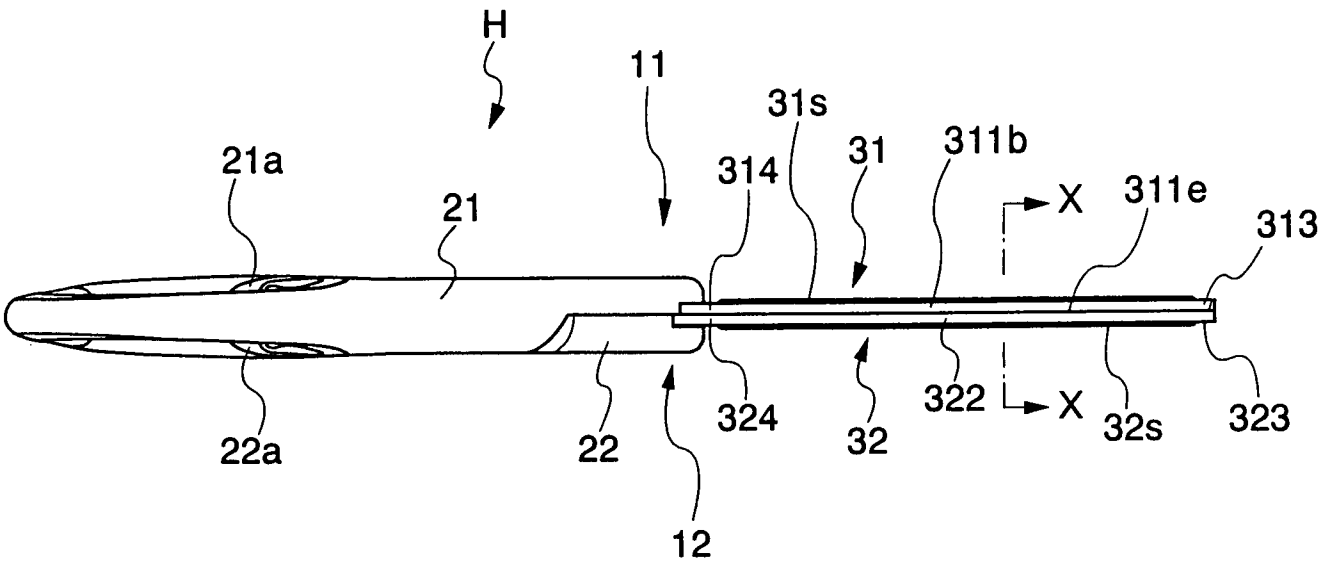
FIG. 3 is a side view of the pair of scissors according to the embodiment.

As shown in FIGS. 1, 2, and 3, a pair of scissors H according to the embodiment is formed by coupling a first scissor body 11 having a movable blade 31 that is a first blade and a second scissor body 12 having a static blade 32 that is a second blade pairing up with the movable blade 31 so that they can turn about a pivot 4.

As shown in FIGS. 1 and 2, the first scissor body 11 is made up of a first handle portion 21 having a first finger ring 21*b* through which a user puts his/her thumb and the movable blade 31 with a base end inserted into and mounted to a front end of the first handle portion 21.

The first handle portion 21 includes a core portion made of rigid material such as thermoplastic resin and a soft portion made of elastic synthetic resin. The soft portion is formed at a first finger pad portion 21*a* that is a contact face with the thumb, i.e., at an inner peripheral portion of the first finger ring 21*b*. Examples of the thermoplastic resin include polyethylene, polystyrene, polypropylene, acrylate resin, and the like. On the other hand, examples of the elastic synthetic resin include rubber material or the like. In the embodiment, these core portion and soft portion are formed by two-color molding. Then, as described above, the base end of the movable blade 31 is inserted into and mounted to the front end of the first handle portion 21.

Figure 4:
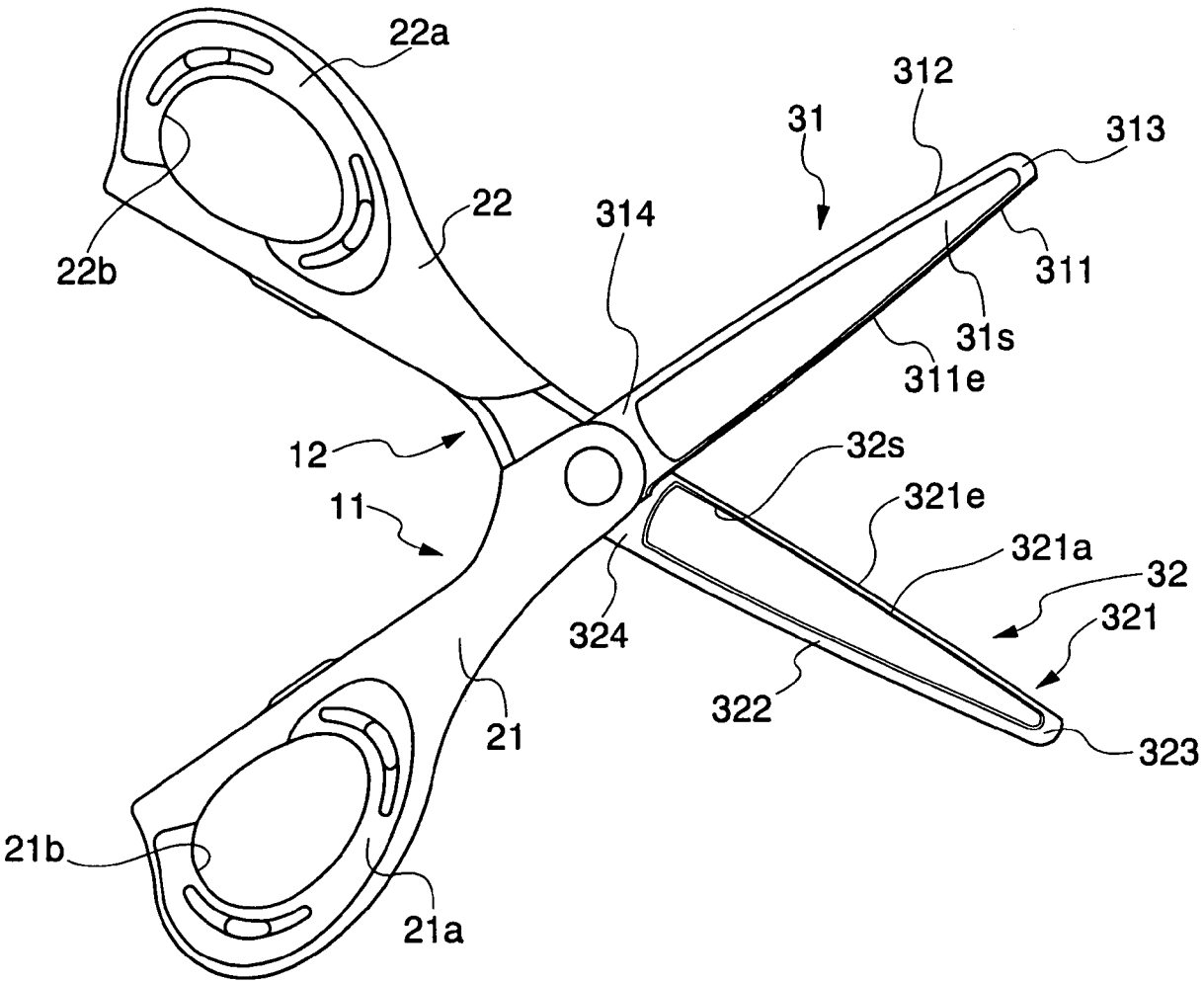
FIG. 4 is a plan view showing an open state of the pair of scissors according to the embodiment.
Figure 5:
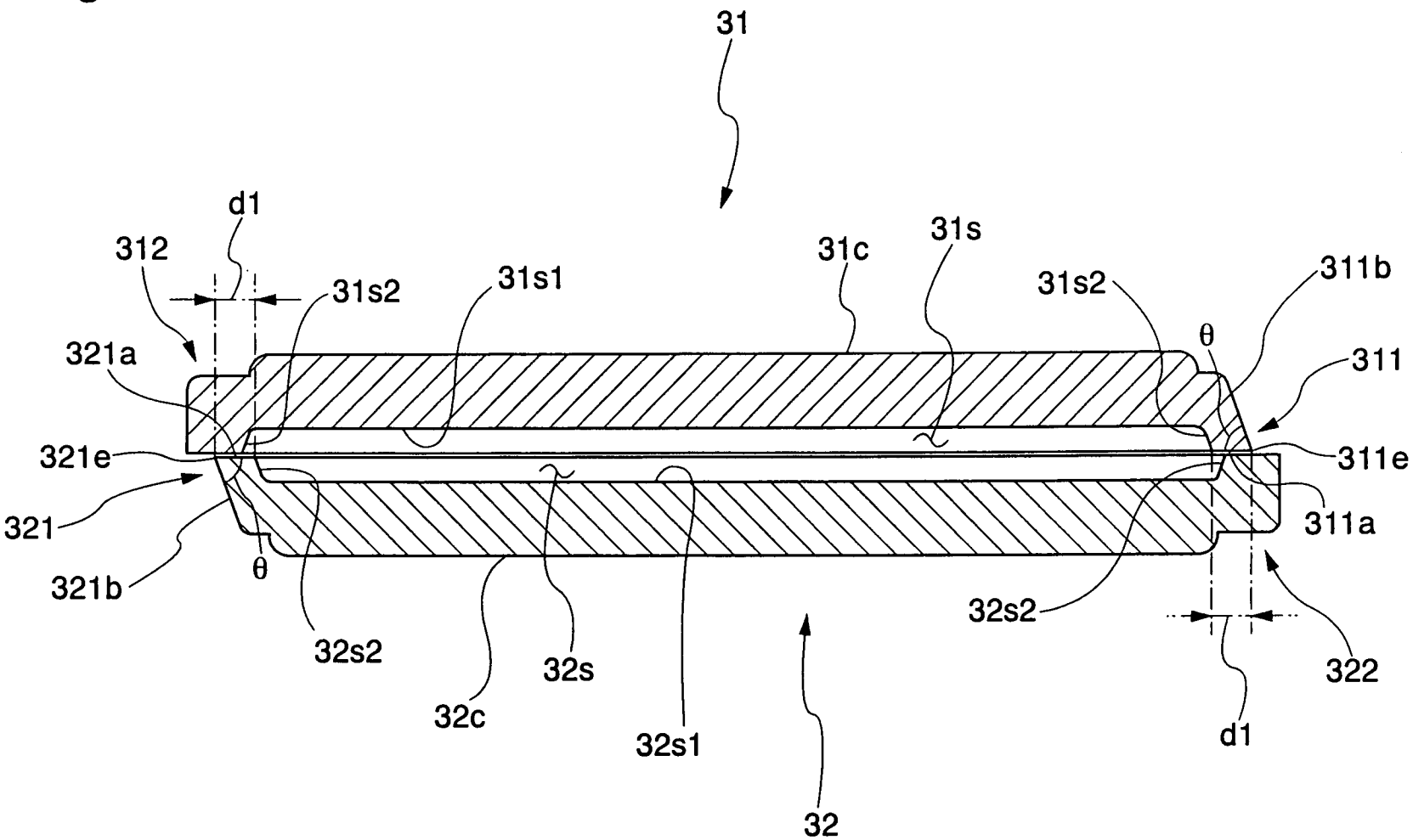
FIG. 5 is a view schematically showing a section along line x-x in FIG. 3.

The movable blade 31 is to be put under paper or the like to cut the paper or the like with the pair of scissors H. The movable blade 31 is made up of a metal sheet made of stainless steel and is in a plate shape formed by integrally pressing the whole body. Thickness of the metal sheet can be set arbitrarily and is set to 1.5 mm in the embodiment. In the embodiment, as shown in FIGS. 4 and 5, the movable blade 31 includes an edge line portion 311 having a flat blade back face 311*a* for sliding against the static blade 32 and a recessed portion 31*s* formed by press forming at a portion adjacent to the edge line portion 311 with a difference in level from the edge line portion 311 and having a bottom face 31*s*1 that is away from a blade back face of the static blade 32 in a thickness direction and is substantially parallel to the blade back face 311*a* of the edge line portion 311, i.e., substantially flat. As described above, the static blade 32 forming the second scissor body 12 is mounted on the movable blade 31 by the pivot 4. A specific structure of the movable blade 31 will be described later. Although a clearance between the movable blade 31 and the static blade 32 is exaggerated in order to facilitate understanding of the structures of the movable blade 31 and the static blade 32 in FIG. 5, the movable blade 31 and the static blade 32 are actually in contact with each other almost without a clearance therebetween.

On the other hand, as shown in FIGS. 1 and 2, the second scissor body 12 is made up of a second handle portion 22 having a second finger ring 22*b* through which the user puts any of his/her index finger, middle finger, and ring finger and the static blade 32 that is the second blade with a base end inserted into and mounted to a front end of the second handle portion 22.

Similarly to the first handle portion 21, the second handle portion 22 includes a core portion made of rigid material such as thermoplastic resin and a soft portion made of elastic synthetic resin. The soft portion is formed at a second finger pad portion 22*a* that is a contact face with the index finger, the middle finger, or the ring finger, i.e., at an inner peripheral portion of the second finger ring 22*b*. Similarly to the first handle portion 21 again, these core portion and soft portion are formed by two-color molding. Then, as described above, the base end of the static blade 32 is inserted into and mounted to the front end of the second handle portion 22.

The static blade 32 pairs up with the movable blade 31 and is to be positioned above the paper or the like to cut the paper or the like with the pair of scissors H. Similarly to the movable blade 31, the static blade 32 is made up of a metal sheet made of stainless steel and is in a plate shape formed by integrally pressing the whole body. In the embodiment, as shown in FIGS. 4 and 5, the static blade 32 similarly includes an edge line portion 321 having a flat blade back face 321*a* for sliding against the movable blade 31 and a recessed portion 32*s* formed by press forming at a portion adjacent to the edge line portion 321 with a difference in level from the edge line portion 321 and having a bottom face 32*s*1 that is away from the blade back face of the movable blade 31 in a thickness direction and is substantially parallel to the blade back face 321*a* of the edge line portion 321, i.e., substantially flat. Then, in sliding the edge line portion 321 of the static blade 32 and the edge line portion 311 of the movable blade 31 against each other to cut tapes and sheets represented by adhesive tapes and kraft tapes on one surface of which an adhesive or the like is applied, the adhesive or the like that has temporarily adhered to the blade back faces 311*a* and 321*a* is pushed into the recessed portions 31*s* and 32*s* by the opposite blades.

The specific structures of the movable blade 31 and the static blade 32 will be described below.

First, as shown in FIGS. 4 and 5 and as described above, the movable blade 31 includes the edge line portion 311 having the flat blade back face 311*a* for sliding against the static blade 32 and the recessed portion 31*s* formed by press forming at the portion adjacent to the edge line portion 311 with the difference in level from the edge line portion 311 and having the bottom face 31*s*1 that is away from the blade back face of the static blade 32 in the thickness direction and is substantially parallel to the blade back face 311*a* of the edge line portion 311, i.e., substantially flat. At the edge line portion 311, an edge line 311*e* is formed between the blade back face 311*a* and a blade surface 311*b*. A blade angle θ between the blade back face 311*a* and the blade surface 311*b* is set to an angle of 70 degrees in the embodiment. Width d1 of the edge line portion 311 is set to be in a range of 0.8 to 1.2 mm and preferably 1.0 mm in the embodiment.

The movable blade 31 further includes a blade back portion 312 formed at an opposite side end edge from the edge line portion 311 and having a back face in the same plane as the blade back face 311*a*, a blade tip portion 313 positioned at a tip end portion and having a back face continuous with and in the same plane as the blade back face 311*a*, and a blade base portion 314 positioned in a vicinity of a base end portion, i.e., the pivot 4 and having a back face continuous with and in the same plane as the blade back face 311*a*. In other words, back faces of the blade back portion 312, the blade tip portion 313, and the blade base portion 314 are continuous with and form the same plane with the blade back face 311*a* that is the back face of the edge line portion 311. Moreover, a continuous step forming face 31*s*2 is formed between the bottom face 31*s*1 of the recessed portion 31*s*, and the blade back face 311*a*, the back face of the blade back portion 312, the back face of the blade tip portion 313, and the back face of the blade base portion 314. Therefore, the recessed portion 31*s* is open only in a direction toward the static blade 32. A portion, which corresponds to the recessed portion 31*s*, of an outer face 31*c* as a face of the movable blade 31 facing away from the static blade 32 is displaced further away from the static blade 32 than the other portion. In other words, in the embodiment, the portion of the substantially flat metal sheet other than the end edge portion is recessed by press forming to form the recessed portion 31*s*. In the embodiment, the bottom face 31*s*1 of the recessed portion 31*s* and the blade back face 311*a* are at least 0.25 mm away from each other in the thickness direction.

On the other hand, the static blade 32 has substantially the same structure as the movable blade 31 in the embodiment. Specifically, as shown in FIGS. 4 and 5 and as described above, the static blade 32 includes the edge line portion 321 having the flat blade back face 321*a* for sliding against the movable blade 31 and the recessed portion 32*s* formed by press forming at the portion adjacent to the edge line portion 321 with the difference in level from the edge line portion 321 and having the bottom face 32*s*1 that is away from the blade back face of the movable blade 31 in the thickness direction and is substantially parallel to the blade back face 321*a* of the edge line portion 321, i.e., substantially flat. At the edge line portion 321, an edge line 321*e* is formed between the blade back face 311*a* and a blade surface 311*b*. A blade angle θ between the blade back face 321*a* and the blade surface 321*b* is set to an angle 70 degrees as well in the embodiment. Width of the edge line portion 321 is the same as the width d1 of the edge line portion 311 of the movable blade. In other words, the width is set to be in the range of 0.8 to 1.2 mm and preferably 1.0 mm in the embodiment.

The static blade 32 further includes a blade back portion 322 formed at an opposite side end edge from the edge line portion 321 and having a back face in the same plane as the blade back face 321*a*, a blade tip portion 323 positioned at a tip end portion and having a back face continuous with and in the same plane as the blade back face 321*a*, and a blade base portion 324 positioned in a vicinity of a base end portion, i.e., the pivot 4 and having a back face continuous with and in the same plane as the blade back face 321*a*. In other words, back faces of the blade back portion 322, the blade tip portion 323, and the blade base portion 324 are continuous with and forms the same plane with the blade back face 321*a* that is the back face of the edge line portion 321. Moreover, a continuous step forming face 32*s*2 is formed between the bottom face 32*s*1 of the recessed portion 32*s*, and the blade back face 321*a*, the back face of the blade back portion 322, the back face of the blade tip portion 323, and the back face of the blade base portion 324. Therefore, the recessed portion 32*s* is open only in a direction toward the movable blade 31. A portion, which corresponds to the recessed portion 32*s*, of an outer face 32*c* as a face of the static blade 32 facing away from the movable blade 31 is displaced further away from the movable blade 31 than the other portion. In other words, in the embodiment, the portion of the substantially flat metal sheet other than the end edge portion is recessed by press forming to form the recessed portion 32*s*. In the embodiment, the bottom face 32*s*1 of the recessed portion 32*s* and the blade back face 321*a* are at least 0.25 mm away from each other in the thickness direction.

In the embodiment, the step forming faces 32*s*1 and 32*s*2 are not orthogonal to the blade back faces 311*a* and 321*a* and the bottom faces 31*s*1 and 32*s*1 of recessed portions 31*s* and 32*s* but inclined with respect to normals to the bottom faces 31*s*1 and 32*s*1.

To cut, by using this pair of scissors H, the tapes or sheets as an object of cutting and represented by adhesive tapes and kraft tapes on one surface of which an adhesive or the like is applied, the edge lines 311*e* and 321*e* of the movable blade 31 and the static blade 32 first come in contact with the object of cutting. Then, if the first and second handle portions 21 and 22 are operated to approach each other, the edge lines 311*e* and 321*e* press the object of cutting from opposite sides of the object of cutting to thereby cut the object. At this time, the blade back faces 311*a* and 321*a* of the edge line portions 311 and 321 slide against each other. At this time, as described above, though the adhesive temporarily adheres to the blade back faces 311*a* and 321*a*, the adhesive is pushed out and moves into the recessed portions 31*s* and 32*s* as the blade back faces 311*a* and 321*a* slide against each other.

As described above, with the structure of the pair of scissors H according to the embodiment, the following effects can be obtained in addition to the above-described effect of moving the adhesive or the like applied on the tape or the sheet as the object of cutting into the recessed portions 31*s* and 32*s* from the blade back faces 311*a* and 321*a* to thereby suppress impairing of the operability of the pair of scissors H due to the adhesive or the like that has adhered to the blade back faces 311*a* and 321*a*. Specifically, even though the blades, i.e., the movable blade 31 and the static blade 32 are formed by press working, the blade back faces 311*a* and 321*a* of the edge line portions 311 and 321 and the bottom faces 31*s*1 and 31*s*2 of the recessed portions 31*s* and 32*s* are substantially parallel to each other and substantially flat and therefore it is possible to form the movable blade 31 and the static blade 32 almost without considering change in shapes due to warping again due to resilience after the flat metal sheets are formed into the blades. Therefore, it is possible to easily form the movable blade 31 and the static blade 32 by press working without requiring high working accuracy by employing any metal sheet. Moreover, with this structure, the whole movable blade 31 and the whole static blade 32 are in substantially flat plate shapes and therefore thickness of the edge line, portions 311 and 321 can be secured and the blade angles θ can be reduced in order to increase sharpness as compared with the movable blade 31 and the static blade 32 with curved sections. Specifically, it is possible to set each of the blade angles θ to the angle of 70 degrees in the pair of scissors H according to the embodiment as described above while the blade angles of the pair of scissors shown in the Kokuyo General Catalog and having the movable blade and the static blade with the curved sections are about an angle of 80 degrees, respectively.

Moreover, because the width d1 of the edge line portions 311 and 321 is set to 0.8 mm to 1.2 mm, it is possible to suppress adhesion of the adhesive to the edge line portions 311 and 321 while securing strength of the movable blade 31 and the static blade 32 of the pair of scissors H, i.e., suppressing occurrence of nicking of the edges that may happen when the width d1 of the edge line portions 311 and 321 is reduced.

Furthermore, because the bottom faces 31*s*1 and 32*s*1 of the recessed portions 31*s* and 32*s* and the blade back faces 311*a* and 321*a* are 0.25 mm or more away from each other in the thickness direction, it is possible to further effectively suppress adhesion of the adhesive to the edge line portions 311 and 321.

Moreover, the movable blade 31 and the static blade 32 include the edge line portions 311 and 321 and the blade back portions 312 and 322 formed at the opposite side end edges from the edge line portions 311 and 321 and having the back faces in the same planes as the blade back faces 311*a* and 321*a* of the edge line portions and the recessed portions 31*s* and 32*s* have the step forming faces 31*s*2 and 32*s*2 respectively formed between the bottom faces 31*s*1 and 32*s*1 and the blade back faces 311*a* and 321*a* of the edge line portions 311 and 321 and between the bottom faces 31*s*1 and 32*s*1 and the blade back faces 311*a* and 321*a* that are the back faces of the blade back portions, which positively influences the strength of the movable blade 31 and the static blade 32.

Furthermore, the movable blade 31 and the static blade 32 further include the blade tip portions 313 and 323 positioned at the tip end portions and having the back faces positioned in the same planes as the blade back faces 311*a* and 321*a* of the edge line portions and the blade base portions 314 and 324 positioned at the base end portions and having the back faces positioned in the same planes as the blade back faces 311*a* and 321*a* of the edge line portions and the step forming faces 31*s*2 and 32*s*2 are further formed between the bottom faces 31*s*1 and 32*s*1 and the blade back faces 311*a* and 321*a* that are the back faces of the blade tip portions and the blade base portions, which further positively influences the strength of the movable blade 31 and the static blade 32.

The present invention is not limited to the embodiment described above.

Figure 6:
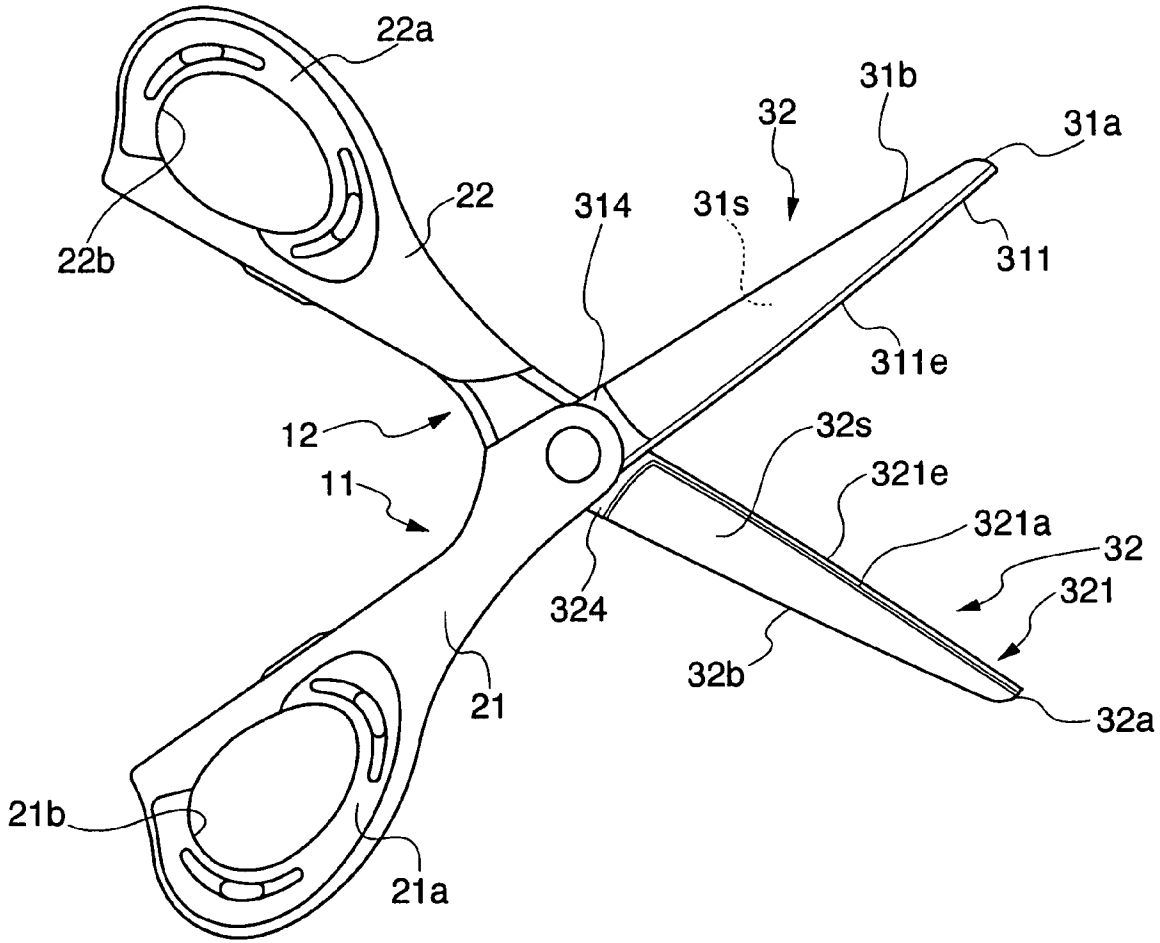
FIG. 6 is a plan view showing an open state of a pair of scissors according to another embodiment of the present invention.

For example, though the recessed portions of the blades are open only in the directions toward the other blades in the embodiment described above, the recessed portions may be open on at least one of the blade tip sides and the blade back sides as well. In FIG. 6, the recessed portions 31*s* and 32*s* are open both on the sides of blade tips 31*a* and 32*a* and on the sides of blade backs 31*b* and 32*b* and portions similar or corresponding to those in the embodiment shown in FIGS. 1 to 5 are provided with similar reference numerals to omit their description.

Although the width of the edge line portions is set to 0.8 mm to 1.2 mm from the viewpoint of performance in the embodiment described above, the width of the edge line portions maybe set to 0.3 mm to 1.2 mm from the view point of practicality. In other words, the width of the edge line portions may be smaller than 0.8 mm if other measures such as employment of high-strength metallic material are taken to increase strength of the edge line portions. If the movable blade and the static blade are made up of metal sheets made of stainless steel and are in plate shapes formed by integrally pressing the whole bodies, the width of about 0.3 mm at the minimum is acceptable as a matter of practicality.

Moreover, the distances between the bottom face of the recessed portions and the blade back faces in the thickness direction may be shorter than 0.25 mm if the pair of scissors is used exclusively for cutting of tapes and sheets on which adhesive less likely to adhere to the blades is applied.

The present invention can be changed in various ways without departing from the gist of the present invention.

What is claimed is:

1. A pair of scissors comprising:

a pair of plate-shaped blades respectively formed by press working; and a pivot connecting a blade base portion of the pair of plate-shaped blades, wherein each of the blades pairing up with each other includes an edge line portion for sliding against the other blade and a recessed portion which is formed at a portion adjacent to the edge line portion with a difference in level from the edge line portion, which is away from a blade back face of the other blade in a thickness direction, and which has a bottom face substantially parallel and substantially flat to a blade back face of the edge line portion, wherein a portion corresponding to the recessed portion in an outer face of each of the blades pairing up has a face substantially parallel and substantially flat to a bottom face of each recessed portion and the recessed portion is open on a blade back side, wherein a width of the edge line portions is set to 0.8 mm to 1.2 mm, and wherein the edge line portion is continuous with and extends along a same plane as a back face of a portion of the blade base portion at which the pivot passes through.

2. The pair of scissors according to claim 1, wherein each of the blades includes the edge line portion and a blade back portion formed at an opposite side end edge from the edge line portion and having a back face positioned in the same plane as the blade back face of the edge line portion and the recessed portion has step forming faces respectively formed between the bottom face and the blade back face of the edge line portion and between the bottom face and the back face of the blade back portion, and wherein the step forming face of the recessed portion of each blade is not orthogonal to the blade back face and the bottom face of the recessed portion such that the step forming face is inclined with respect to the bottom face of the recessed portion.

3. The pair of scissors according to claim 1, wherein each of the blades includes the edge line portion and a blade back portion formed at an opposite side end edge from the edge line portion and having a back face positioned in the same plane as the blade back face of the edge line portion and the recessed portion has step forming faces respectively formed between the bottom face, the blade back face of the edge line portion and between the bottom face and the back face of the blade back portion, and between the bottom face and the back face of the blade base portion.

4. The pair of scissors according to claim 2, wherein each of the blades further includes a blade tip portion positioned at a tip end portion and having a back face positioned in the same plane as the blade back face of the edge line portion and the blade base portion positioned at a base end portion and having the back face positioned in the same plane as the blade back face of the edge line portion and step forming faces are further formed between the bottom face and the back face of the blade tip portion and between the bottom face and the back face of the blade base portion.

5. The pair of scissors according to claim 3, wherein each of the blades further includes a blade tip portion positioned at a tip end portion and having a back face positioned in the same plane as the blade back face of the edge line portion and the blade base portion positioned at a base end portion and having the back face positioned in the same plane as the blade back face of the edge line portion and step forming faces are further formed between the bottom face and the back face of the blade tip portion.

6. The pair of scissors according to claim 1, wherein the pivot extends through the back face of the blade base portion of the pair of plate-shaped blades.

7. The pair of scissors according to claim 1, wherein the edge line portion and the back face of the blade base portion are formed of a same member.

* * * * *